US006673209B1

(12) United States Patent
Vilmusenaho

(10) Patent No.: US 6,673,209 B1
(45) Date of Patent: Jan. 6, 2004

(54) METHOD FOR STORING AND HANDLING A ROLL IN A PAPER MACHINE, INCLUDING A ROLL BOX

(75) Inventor: Esa Vilmusenaho, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/889,111

(22) PCT Filed: Jan. 10, 2000

(86) PCT No.: PCT/FI00/00012

§ 371 (c)(1),
(2), (4) Date: Jul. 9, 2001

(87) PCT Pub. No.: WO00/44656

PCT Pub. Date: Aug. 3, 2000

(30) Foreign Application Priority Data

Jan. 13, 1999 (FI) ..... 990013 U

(51) Int. Cl.[7] ..... B65H 19/00; D21G 9/00; B60P 3/35

(52) U.S. Cl. ..... 162/199; 162/272; 206/397

(58) Field of Search ..... 162/118, 121, 162/198, 199, 207, 263, 272, 283, 284; 206/389, 397, 398, 407; 414/265, 911, 147, 148, 161, 222.02, 222.07; 242/533.8, 557, 905, 909; 198/341.01; 483/14

(56) References Cited

U.S. PATENT DOCUMENTS

| | | | | |
|---|---|---|---|---|
| 5,619,807 A | * | 4/1997 | Conrad | 162/121 |
| 5,651,863 A | | 7/1997 | Van Haag et al. | 162/207 |

FOREIGN PATENT DOCUMENTS

| | | | |
|---|---|---|---|
| DE | 19606554 | 6/1997 | B66F/9/06 |
| JP | 9226445 | 9/1997 | B60P/3/035 |
| WO | 9317946 | 9/1993 | B65H/19/00 |
| WO | 9812132 | 3/1998 | B65H/19/12 |

* cited by examiner

*Primary Examiner*—Eric Hug
(74) *Attorney, Agent, or Firm*—Fildes & Outland, P.C.

(57) ABSTRACT

A method for storing and handling a roll of a paper machine, board machine, or finishing machine includes using a special base arranged for the roll on which the roll is moveable from its operating location to a roll store and/or to a transport, or for storing the roll in the store. The base is made into a roll box inside of which suitable heat and humidity conditions are arranged for the roll. The conditions are maintained when using such a base or area as the roll store.

12 Claims, 4 Drawing Sheets

METHOD FOR STORING AND HANDLING A ROLL IN A PAPER MACHINE, INCLUDING A ROLL BOX

TECHNICAL FIELD

The present invention relates to a method for storing and handling a roll of a paper machine, board machine, or finishing machine, in which method a special base is arranged for the roll, for moving the roll from its operating location to a roll store and/or to a means of transportation, or for storing the roll in the roll store. The invention also relates to a roll box for use in the method.

BACKGROUND OF THE INVENTION

When a roll is removed from its operating location, it is generally stored on top of a base prepared for it. Usually, the roll is also secured on its base, so that the roll and the base can be moved together. When a roll is transported from the manufacturer to the operating location, and later from the operating location for servicing or renovation, structures are added around the base to form a box. Despite the box, however, the roll is subject to variations in temperature and humidity, so that the box can only be used during transportation. Even then, the roll suffers form variations in conditions, therefore an attempt is made to keep the roll in the box for as short a time as possible. This leads to a tight transport schedule and other special arrangements when handling the roll.

At the operating location, such as in a paper mill, there are generally spare rolls for the rolls being used in the machines. As the rolls used in paper machines, board machines, and finishing machines are large and heavy, a gantry crane is usually needed to move them. Spare rolls and other rolls that have been removed from their operating locations are stored in a special roll store, which usually has to be located close to the machine hall. This is because the roll store gantry crane transfers the roll to the machine hall gantry crane, which then moves it to the machine. A gantry crane or some other sufficiently powerful crane is also required to load the roll onto a truck. The hoists on trucks cannot handle large and heavy rolls.

A general drawback when handling and storing present-day rolls is the acquisition and maintenance of special stores and equipment. The rolls demand a special roll store, which must be dimensioned according to the most demanding roll. The temperature and humidity in the roll store must be constantly maintained at a suitable level for the roll. In practice, the roll store then becomes large, so that the maintenance of suitable conditions consumes a great deal of energy. In addition, the rolls can usually only be handled with a gantry crane, which is must correspondingly be dimensioned according to the largest roll. However, the capacity utilization of the gantry crane remains very low, as rolls are changed relatively seldom. The unsatisfactory final result is a large and warm roll store, with a massive gantry crane. The loading of roll boxes onto various means of transportation is also one of the problematic aspects of the state of the art.

SUMMARY OF THE INVENTION

The invention is intended to create a method, by means of which a roll of a paper machine, board machine, or finishing machine can be handled and stored more easily and with the aid of simpler equipment. In addition, the invention is intended to create a roll box for use in the method, which can be used continuously, for both roll transportation and storage, without needing special buildings and handling equipment. A method for storing and handling a roll of a paper machine, board machine, or finishing machine, in which method a special base is arranged for the roll, for moving the roll from its operating location to a roll store and/or to a means of transportation, or for storing the roll in the store, is characterized in that the base is made into a roll box, inside of which suitable heat and humidity conditions are arranged for the roll, which are maintained when using such a room or area as the roll store, in which the heat and humidity conditions are either poorly regulated or not regulated at all.

The roll box may be equipped with wheels and moveable by being pushed and/or pulled by a transport vehicle, such as a forklift truck.

The roll box, is intended to protect a roll during storage and transportation, and includes a base with a detachable or raisable cover fitted to it, and devices for securing the roll to the base. The roll box includes devices for maintaining suitable heat and humidity conditions in the roll box for the roll.

The equipment may include air-conditioning equipment and its monitoring and control equipment, and insulation fitted to the base and/or the cover and essentially covers the entire roll box.

The roll box may include support wheels at least one end of the base, the axis of rotation of which is arranged essentially transversely to the roll box, and connecting devices at the other end of the base to allow the roll box to be handled by a transport vehicle, such as a forklift truck. The support wheels may be arranged within the external dimensions of the roll box in the transverse direction. A second set of support wheels may be arranged, in addition to the connecting devices, at the aforesaid other end of the base. A power source and steering devices may be connected to the second set of support wheels.

The method may include equipment for identifying, positioning, and/or servicing the roll.

A method of storing one or more rolls for a paper machine, board machine, or finishing machine, includes:

containing each roll in a moveable carrier having an environmentally controllable interior;

storing said contained roll at a location in the vicinity of an operating location; and transporting a said contained roll as needed to the operating location;

whereby said roll is stored without investment in a warehouse and a gantry crane. The roll box according to the invention forms not only a transport base, but also a storage space. In addition, the roll box can be handled using many different kinds of equipment, which are general equipment at the place of use of rolls. As they can be easily moved, the rolls need not be stored close to the machine, allowing the location of the roll store to be chosen freely. This also permits existing roll stores to be used more productively while the new stores need not be all in one place or heated. Each roll is stored in the roll box in suitable conditions. The roll box according to the invention s suits all roll-like objects, but especially large and fragile rolls. The roll box does not represent a large investment, because even at present transportation bases are made for most new rolls and, in many cases, paper mills additionally purchase a separate box for transporting the roll.

In the following, the invention is described in detail with reference to the accompanying drawings illustrating some embodiments of the invention, in which

DETAILED DESCRIPTION OF THE INVENTION

Figure 1:
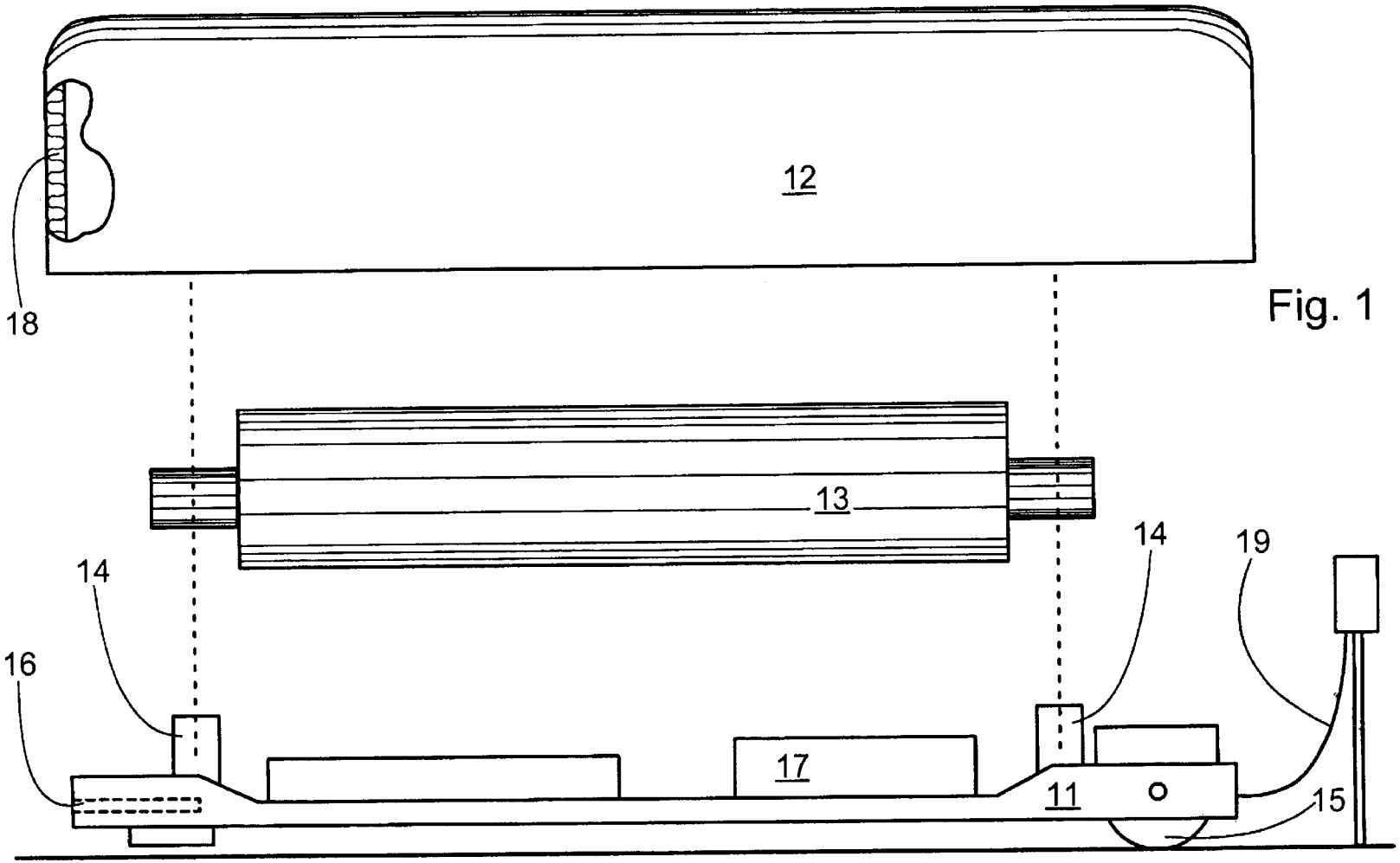
FIG. 1 shows a roll box according to the invention seen from the side, with the roll and the cover raised.

FIG. 1 shows a side view of a roll box according to the invention. In the rest of the disclosure, the roll box will be referred to more simply as a box. The box includes a base 11 and a cover 12 fitted to it. It may be possible to lift the cover 12 entirely, as shown in FIG. 1, or it may be able to be moved to the side, or may be equipped with a top that can be opened. The roll 13 is preferably lifted onto and off base 11 using a gantry crane, which is generally available in machine halls and maintenance areas. In addition, base 11 has suitable devices 14 for securing roll 13.

Cover 12 preferably extends outside base 11, so that the box can be closed tightly. Various kinds of base have been previously used in the transportation of rolls, but the box 10 according to the invention preferably includes support wheels 15, at least at one end of the base 11. The support wheels 15 are arranged in such a way that the axis around which they rotate is set essentially transversely to box 10. In other words, box 10 can be moved on support wheels 15 in its longitudinal direction. In addition, there are connecting devices 16 at the other end of box, allowing the box to be handled by a transportation vehicle, such as a forklift truck 22. Thus, the movement of the box no longer requires a gantry crane. At the same time, the handling of the box becomes less restricted, as it is no longer dependent on the tracks of gantry cranes.

Unlike known boxes, box 10 according to the invention is also used to store roll 13. For this purpose, box 10 includes devices 17 for maintaining heat and humidity conditions within box 10 suitable for roll 13. Such a box may also include the support wheels and connecting devices referred to above, or may have none of these. In the latter case, the box is handled mainly by lifting, for example, using a gantry crane.

In order to stabilize the conditions to be suitable for the roll, the devices 17 includes air-conditioning equipment and monitoring and control equipment for it. In addition, insulation 18, which essentially covers the entire box 10, is fitted to the base 11, the cover, or both. Because the base carries the weight of the roll, the cover may be of a lightweight construction. It is preferable to use a sandwich method in its manufacture, so that the final result is a light, but nevertheless stiff cover. The cover is also manufactured and fitted to the base in such a way that the closed box is airtight. Thus, little energy is used to maintain the internal conditions in the airtight and insulated box. Even the shaping of the box can affect the energy economy of the box. A streamlined box has a low air resistance. In addition, snow and water will immediately run off a suitably shaped cover.

During storage, box 10 is connected to the mains electricity and information networks with the aid of connecting cables 19. In all other respects, box 10 operates completely independently. As required, the air-conditioning device can either heat or cool the air inside the box while also maintaining the desired humidity. In addition, the air-conditioning device circulates the air, evening the temperature and humidity in the different parts of the box. The air-conditioning device can be installed to operate at a constant output, but preferably measuring and control devices can continually monitor and adjust the operation of the equipment, and thus the conditions inside the box. In this way, if problems arise, the box can be examined immediately, before the roll is damaged. During loading onto a vehicle, the box can easily be disconnected from the power supply, because large rolls in particular store a great deal of heat. Alternatively, the box can incorporate, for example electrical or thermal batteries, in case of power cuts. During transportation, the box is connected to the electrical system of the means of transport.

The box is intended to be handled by some transportation vehicle. Generally, there are numerous forklift trucks at the operating locations of rolls, with sufficient capacity to transport the box and the roll. After all, the support wheels carry at least half of the weight of the box. In their simplest form, the connecting devices are concavities formed in the base, into which the arms of the truck's fork fit and lock. Other types of connecting devices are also possible. In addition, the support wheels of the box are arranged transversely within the external dimensions of the box. Thus, the support wheels do not add to the overall dimensions of the box, which reduces the storage space needed. At the same time, the support wheels are protected and two large boxes can be loaded side by side onto the means of transport, such as a truck with a semi or full trailer.

More highly developed embodiments may have not only connecting devices, but also a second set of support wheels (not shown) at the other end of the base. This allows the box to be handled by devices that have insufficient capacity to lift it. A power source and steering devices may also be attached to the aforesaid second set of support wheels. In such a case, the box can be handled without a separate transportation vehicle, so that in a sense the box is its own transportation vehicle.

Figure 2:
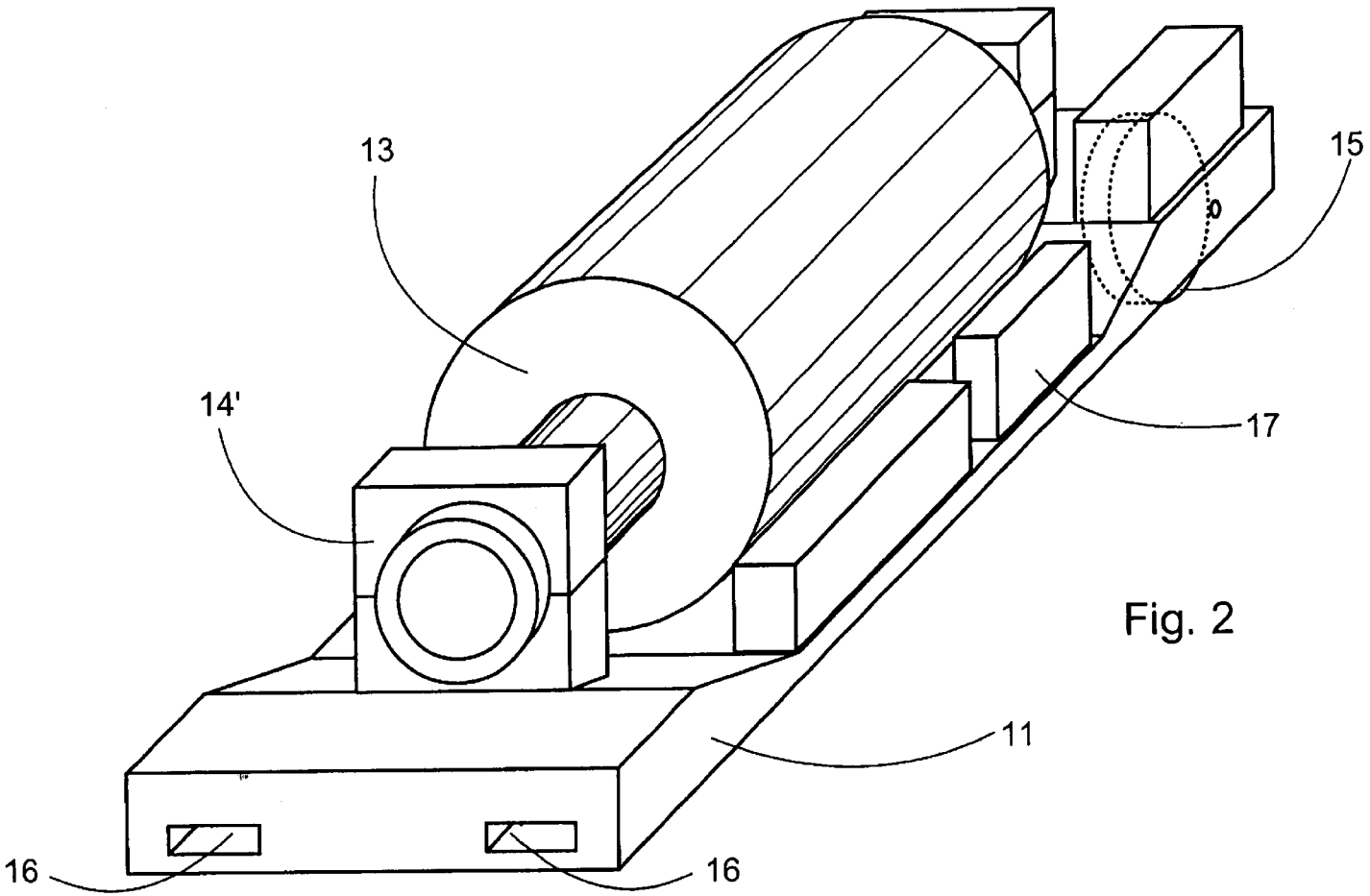
FIG. 2 shows an axonometric end view of the base of a roll box according to the invention and a roll secured to it.

FIG. 2 shows base 11 with a roll 13 secured to it. The same reference numbers are used for the parts with a similar function. Roll 13 can be secured to base 11 in several different ways. For example, base 11 includes fixed supports 14', on which roll 13 is set, secured by its bearing journals. Another alternative is to secure the bearings directly to the base, when the roll can be rotated. This roll rotation, with the addition of oil-circulation lubrication, will keep the bearings in operating condition, so that the roll is ready for use immediately after installation. Certain rolls also demand rotation during storage. If necessary, the air-conditioning device can be used to raise the temperature of the roll to near to the operating temperature before installation. In addition, the storage space can act as a servicing base. The base can also be equipped with an electrically operated hydraulic hoist, which allows the bearing assemblies to be dismantled and installed. Similarly, the roll's documentation and service tools and spare parts travel in the box. In this case, for example, the bearings can be repaired and serviced practically anywhere. The box can also include accompanying memory and positioning devices, to identify the roll and determine its position at any time, and to record servicing information.

Figure 3:
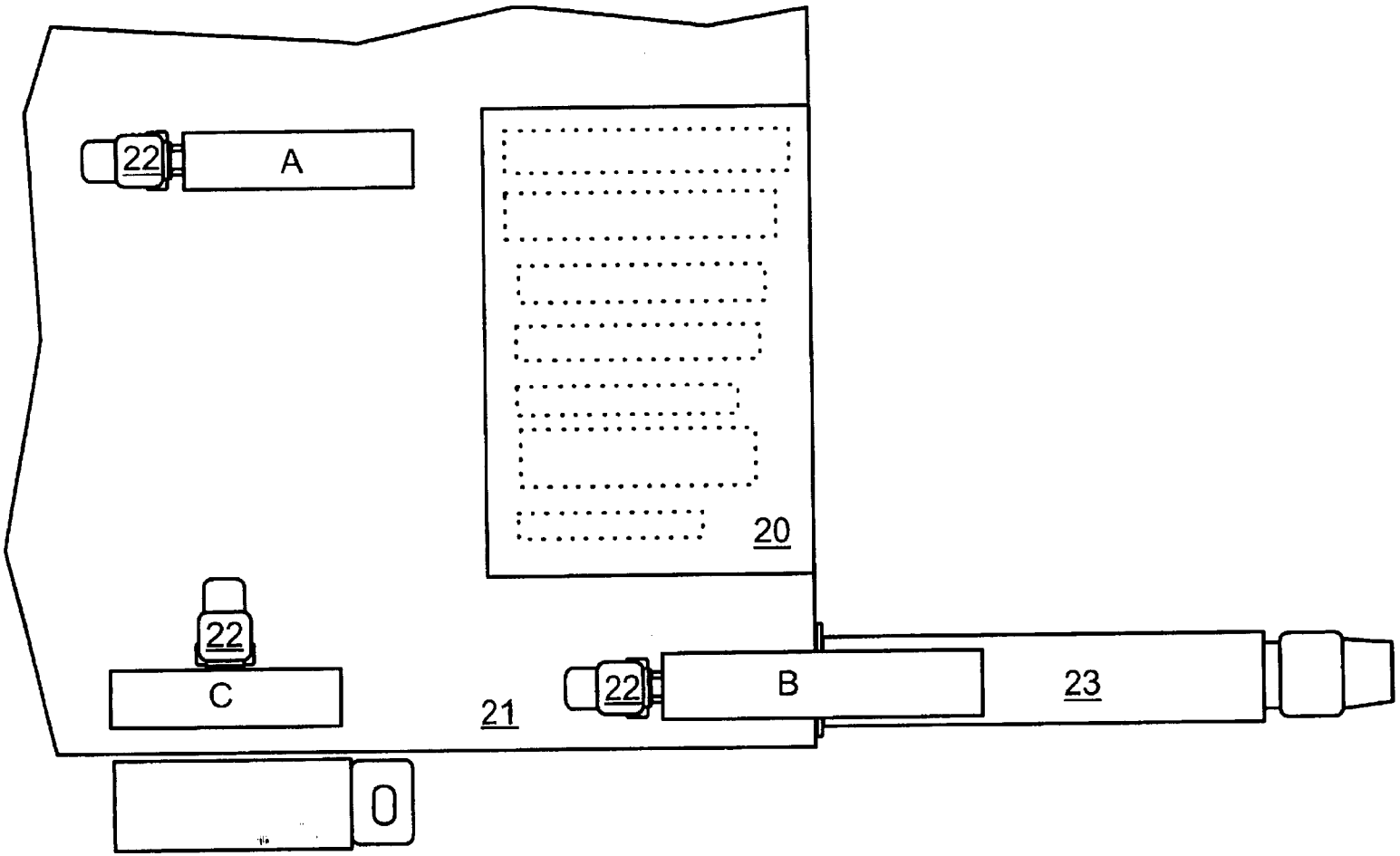
FIG. 3 shows a diagram of the various stages of the method according to the invention.

FIG. 3 shows various ways of handling the box. The box is preferably transported in a horizontal position, with the aid of a traction device or forklift truck 22, from the machine hall to the roll store 20 and back (box A). According to the method, roll box 10 is equipped with wheels 15 and roll box 10 is moved by being pushed, pulled, or both by a transport vehicle, such as forklift truck 22. Thus, the roll store 20 can be freely located in the vicinity of the operating location, while a gantry crane is not needed in roll store 20. In the same way, the box is loaded from loading bay 21 onto a road-haulage vehicle or a train (box B). Short and light boxes can also be loaded sideways (box C).

According to the method, the base is made into a box. Thus, suitable heat and humidity conditions for the roll are created and maintained inside box 10. A box according to the invention can be adapted as a winter store in a covered or cold store area, in which there need not be a gantry crane. Generally, rooms or areas, in which the heat and humidity conditions are poorly regulated, or not regulated at all can be used as roll stores. Thus, in principle, the box can also be stored out-doors, but in that case the energy consumption of the air-conditioning equipment will probably increase. On the other hand, short-term storage outdoors has advantages when the roll is sent for servicing or surfacing. In that case, the loading and unloading of the box can be carried out independently by the transport crew, irrespective of whether a gantry crane is available. This increases the flexibility of logistics. An unheated store is a preferable place for the box with its roll, because the conditions are even throughout the year, and are not disturbed by rain and wind. Thus, for example, an empty end-product store is suitable as a roll store. As logistics become more efficient, end-product storage space is being released at mills, so that additional investments are not required for a special roll store.

Figure 4:
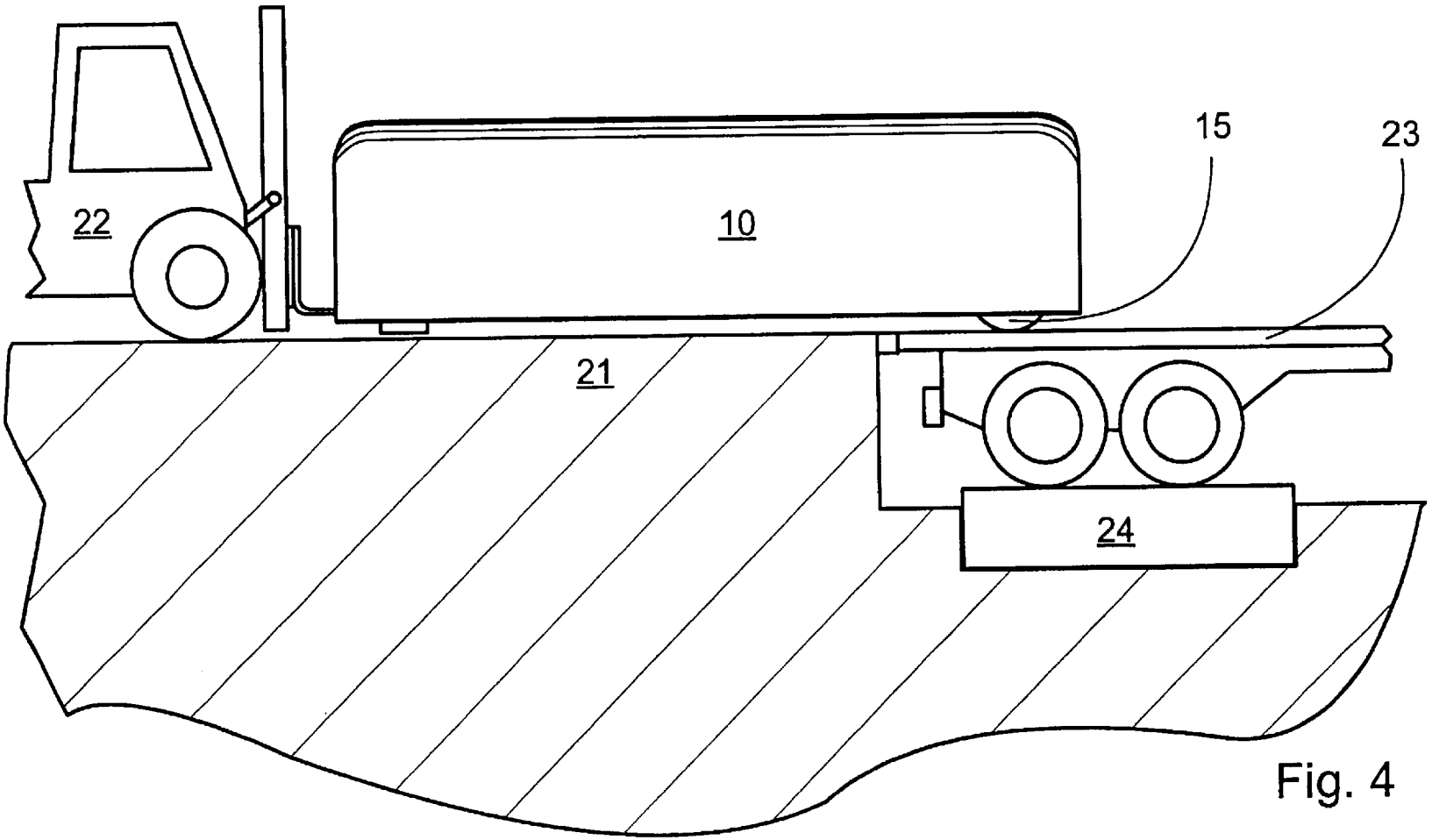
FIG. 4 shows a side view of one manner of loading applying the method according to the invention.

FIG. 4 shows box 10 being loaded onto a road-haulage vehicle. In FIG. 4, the bed of semi-trailer 23 is arranged at the height of loading bay 21, when box 10 can be simply pushed by vehicle 23. This also permits the use of a covered trailer, as the box is loaded by pushing and not by lifting. At the same time, loading is speeded up, because it is not necessary to remove the cover of the load space. Lifting devices 24 according to the example are available for adjusting the height. Sufficient height adjustment can also be obtained by using the vehicle's air suspension.

In general, boxes are dimensioned taking the size of the means of transportation into account. In addition, standard securing devices (not shown) are fitted to the box, to secure it to the means of transport. So-called container locks are preferable as the securing devices. The roll is secured to the base by means of retaining devices that will withstand the stresses of loading and transportation. All that the transport crew must do is to secure the container to the vehicle. In addition to the securing devices, frameworks can be attached to the box, to allow boxes to be transported and stored on top of each other. It is preferable to use container locks with the frameworks too. In this case, a sufficiently powerful crane must be available.

A roll box according to the invention can be used to easily create a suitable storage solution for each roll, without investments in an expensive heated warehouse and a gantry crane. The solution permits the use of leasing or a similar flexible form of financing, releasing capital for more productive purposes. In addition, energy is saved, as the space to be heated is substantially reduced in comparison to a conventional store. The handling of the roll box also becomes easier and flexible.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claim.

What is claimed is:

1. A method for storing, handling and transporting a roll of a paper machine, board machine, or finishing machine the method comprising:

providing a moveable base for the roll, said moveable base being made into a roll box;

controlling the temperature and humidity conditions inside of the roll box to obtain desired temperature and humidity conditions suitable for tile roll; and maintaining the temperature and humidity conditions inside the roll box.

2. A method according to claim 1, further comprising the step of providing the roll box with wheels.

3. A method according to claim 1, further comprising the step of providing equipment for identifying, positioning, and/or servicing the roll.

4. A roll box for a roll of a paper machine, board machine, or finishing machine, which roll box includes a movable base with a detachable or raisable cover fitted to it, and devices for securing the roll to the moveable base, characterized in that the roll box includes devices for controlling temperature and humidity conditions in the roll box.

5. A roll box according to claim 4, characterized in that the devices for controlling temperature and humidity include air-conditioning equipment and associated monitoring and control equipment.

6. A roll box according to claim 4, characterized in that insulation is fitted to the base and/or the cover and essentially covers the entire roll box.

7. A roll box according to claim 4, characterized in that the base of the roll box has two ends and the roll box further includes support wheels at least at the first end of the base, the axis of rotation of which support wheels is arranged essentially transversely to the roll box, and that there are connecting devices at the second end of the base adapted to allow the roll box to be handled by a transport vehicle.

8. A roll box according to claim 7, characterized in that the roll box has external dimensions within which the support wheels are arranged in the transverse direction.

9. A roll box according to claim 7, characterized in that a second set of support wheels are arranged, in addition to the connecting devices, at the aforesaid second end of the base.

10. A roll box according to claim 9, characterized in that a power source and steering devices are connected to the second set of support wheels.

11. A roll box according to claim 4, characterized in that the roll box includes equipment for identifying, positioning, and/or servicing the roll.

12. A method of storing one or more rolls for a paper machine, board machine, or finishing machine, the method comprising:

containing each roll in a moveable carrier having an environmentally controllable interior;

storing said contained roll at a location in the vicinity of an operating location; and transporting a said contained roll as needed to the operating location;

whereby said roll is stored without investment in a warehouse and a gantry crane.

* * * * *